US006907996B1

(12) United States Patent
Fraas

(10) Patent No.: US 6,907,996 B1
(45) Date of Patent: Jun. 21, 2005

(54) APPLICATION OF COMPLEX-MODE VIBRATION-FLUIDIZED BEDS TO THE SEPARATION OF GRANULAR MATERIALS OF DIFFERENT DENSITY

(76) Inventor: Arthur P. Fraas, 1040 Scenic Dr., Knoxville, TN (US) 37919

( * ) Notice: Subject to any disclaimer, the term of this patent is extended or adjusted under 35 U.S.C. 154(b) by 83 days.

(21) Appl. No.: 09/907,808

(22) Filed: Jul. 19, 2001

Related U.S. Application Data

(60) Provisional application No. 60/219,413, filed on Jul. 20, 2000.

(51) Int. Cl.[7] ..... B07B 5/02

(52) U.S. Cl. ..... 209/435; 209/441; 209/448; 209/449; 209/504

(58) Field of Search ..... 209/435, 440, 209/441, 445, 448, 449, 460, 490, 493, 494, 504

(56) References Cited

U.S. PATENT DOCUMENTS

| | | | | | |
|---|---|---|---|---|---|
| 1,813,303 | A | * | 7/1931 | Lide | 209/467 |
| 2,079,059 | A | * | 5/1937 | Winkleman | 131/110 |
| 2,104,090 | A | * | 1/1938 | Montomery | 209/457 |
| 2,609,098 | A | * | 9/1952 | Lotz | 209/457 |
| 4,206,046 | A | * | 6/1980 | Haight | 209/481 |
| 4,240,903 | A | * | 12/1980 | Stoev et al. | 209/437 |
| 4,294,693 | A | * | 10/1981 | Brennan | 209/466 |
| 4,493,556 | A | | 1/1985 | Prew | |
| 4,741,443 | A | * | 5/1988 | Hanrot et al. | 209/44.1 |
| 4,894,148 | A | | 1/1990 | Frei | |
| 5,087,351 | A | * | 2/1992 | Valentine, Sr. | 209/20 |
| 5,244,099 | A | * | 9/1993 | Zaltzman et al. | 209/466 |
| 6,234,319 | B1 | * | 5/2001 | Wang | 209/479 |
| 6,250,479 | B1 | * | 6/2001 | Satake et al. | 209/481 |

OTHER PUBLICATIONS

Fraas, A. P., *A new approach to fluidization of solids; complex–mode vibration–fluidization*; Paper presented at the AICHE Meeting; Nov. 10–15, 1996.

Kleinberg et al.; *Probing Gas Hydrate Deposits*; American Scientist, vol. 89' (May–Jun. 2001); pp. 244–251.

* cited by examiner

*Primary Examiner*—Donald P. Walsh
*Assistant Examiner*—Joseph C Rodriguez
(74) *Attorney, Agent, or Firm*—James Creighton Wray; Meera P. Narasimhan

(57) ABSTRACT

Opposite ends of a dry vibration-fluidized separator are moved with complex vibrations, including linear, whirl, linear plus whirl, oscillation, linear plus oscillation, pitch and roll. Near zero to large amplitudes up to about ±0.050 inches and low frequencies of about 30 Hz are used. Mixed particulate materials are fed into a first end and circulate across and along the separator in a shallow depth. More dense materials move linearly along a floor and are removed through an opening in a second end of the floor. The less dense materials flow over a weir at the second end of the separator.

17 Claims, 4 Drawing Sheets

TYPES OF VIBRATORY MOTION
POSITIONS OF OUTER SHELL RELATIVE TO "AT REST" POSITION OF INNER CORE AT 90 DEG INTERVALS IN TYPICAL CYCLES

APPLICATION OF COMPLEX-MODE VIBRATION-FLUIDIZED BEDS TO THE SEPARATION OF GRANULAR MATERIALS OF DIFFERENT DENSITY

This application claims the benefit of U.S. Provisional Application No. 60/219,413, filed Jul. 20, 2000.

BACKGROUND OF THE INVENTION

Particles differing in density may be separated by using hydrostatic forces, such as used in separating coal from rock and pyrites in aqueous and non-aqueous slurries, but that entails large expenditures of energy for removing the water, drying the product, and treating the waste water. The usual methods for separating particles of differing density utilize hydrostatic forces as in coal washing or ore beneficiation. Those operations commonly employ a water slurry that flows slowly through a system of troughs. The denser particles drift toward the bottom, leaving the less dense particles in the upper layers. The flow is usually laminar, and a large number of stages may be employed a where the ore concentration in the initial feed may be as low as 0.05%,.as is the case in copper mining operations. In coal cleaning, on the other hand, the bulk of the raw feed material is coal, while the rock and/or pyrite to be removed is only 1 to 20%. Major disadvantages of this wet slurry approach are the contamination of the water required and the large amount of energy required to dry the product where it constitutes the bulk of the feed, as is the case for coal cleaning operations. If gas-fluidized beds are employed to avoid those problems, the pumping power required is substantial and the dust problems are formidable.

Both of those problems may be alleviated somewhat by employing an "air flow jig" in which a thin bed of crushed coal flows over a vibrated plate that is perforated to introduce a stream of air to fluidize the bed. However, this system is not sufficiently attractive to have led to more than a very limited commercial use. Air flotation may be employed, but this is effective only for mixtures having a small range of particle size and presents difficult problems with dust.

A low attrition dry process is particularly advantageous for removing mineral matter from low-rank coals, such as lignite, in a which the lumps are quite frangible even when dry, and their frangibility is greater when wet. Many efforts to effect density separation through the use of vibrating beds have been made in the past, but none has been effective. Rather than acting as separators, vibrating beds have proved to be an excellent means for obtaining homogeneous mixtures of granular materials differing in density, e.g., corn starch and foundry sand, for making dry sand cores. All of these efforts have employed vibratory motions given by the vast majority of the vibrating machines on the market that produce a simple linear vibratory motion, or the balance that produce a simple whirl.

At first thought, one would expect that vibration-fluidized beds could be used to give a dry process. On the surface it would seem that vibration would aid the usual separation operation, and that when a bed is fluidized by vibration the dense particles should sink to the bottom. One patent that has been granted for such a separation process is U.S. Pat. No. 4,894,148 (the '148 patent), issued Jan. 16, 1990. The abstract of the '148 patent states that "[t]he mass is received in a trough-shaped [container] and subjected to vibration causing high density constituents to segregate downwards and low density constituents to segregate upwards, so that the fractions may be removed at different layer levels." FIG. 1 of the '148 patent shows an old-fashioned bathtub-shaped casing with three outlets, one at the top, one at an intermediate level, and one at the bottom. However, no experimental evidence of its effectiveness is cited in the '148 patent, and people with extensive experience with vibrating beds (e.g., Prof. Arthur M. Squires at VPI&SU) state that they have looked for but never found any evidence of particle separation as a consequence of differences in particle density in conventional vibrating beds.

Several patents have been issued for the use of vibrating beds to mix granular materials differing in particle size, density, and character. U.S. Pat. No. 4,493,556, issued Jan. 15, 1985, cites experimental confirmation of the outstanding-effectiveness of the linear motion vibrating bed for mixing flour and sand (apparently for making dry sand cores for foundry molds). The effectiveness of the linear motion vibrating bed for mixing materials of different character, particle size, and density negates the use of simple linear vibratory motion for separating particles on the basis of density with a simple linear vibratory-motion. Another significant point is that there is a tendency for larger particles to work toward the surface when operating with granular materials differing in particle size but having the same grain density. The effect is small, but nonetheless it definitely is present.

All present methods and apparatus have employed the usual simple linear vibratory motion, either vertically or inclined to the vertical at some angle. A need exists for the effective separation of granular matters of different densities that overcomes the aforementioned problems.

SUMMARY OF THE INVENTION

The present invention is an apparatus and method for a dry separation process using a complex-mode vibration-fluidization, i.e., a carefully chosen combination of linear, whirl, oscillation, pitching, and rocking motions, that is generated by machines especially designed to produce these unusual motions.

The physical basis for this new density separation process lies in the basic difference in the character of the particle motion and bed flow in a vibration-fluidized bed where the dominant driving forces involve the interchange of momentum. The hydrostatic and hydrodynamic forces that govern conventional fluid flow, whether ideal potential flow, laminar flow, or turbulent flow, have only secondary effects in vibration-fluidized flow, and are useless in the design of vibration-fluidized beds.

The proper combination of linear, whirl, oscillation, pitching, and rocking motions for a good particle density separation process depends on the particle size distributions for the lower and higher density particles, the vibration amplitude and frequency, the elastic characteristics of the particles, and some twenty-other secondary variables, so that experiments are required to establish the proper combination of vibratory modes for any particular application. Thus, there is no simple way to delineate the combination of vibratory modes that produce a good separation factor for any given set of granular materials, but it has proved possible to delineate the analytical procedures for selecting promising combinations of vibratory modes, to design a vibrating machine to produce the desired vibrational mode, and to use experimental techniques that may be used in conjunction with the analyses to find and define particular sets of conditions that give good separation factors for many applications.

These and further and other objects and features of the invention are apparent in the disclosure, which includes the above and ongoing written specification, with the claims and the drawings.

This invention provides the combining of variously linear, whirl, oscillation, pitching, and rocking vibratory motions to fluidize a vibrated bed of granular or powdery materials in such a way as to give particle motions and bed flow patterns that separate materials of different density. This makes possible a dry fluidized bed steady through-flow process that does not require (but may employ) a gas flow to assist in fluidizing or drying the stream of solids.

Complex-mode vibratory motions variously include the thousand of different combinations of linear, whirl, oscillation, pitching, and rocking motions. These motions may be produced by many different machines including motor-driven shafts fitted with eccentric weights, or by linkages driven by electromagnets, or hydraulic or pneumatic cylinders.

The relative magnitude, frequency, and phase angle of the various components of the vibratory motion may be varied from zero to large amplitudes by such measures as changing the size of eccentric weights or their effective radius of action, the relative speed of shafts by changing gear ratios, and the position of the center of gravity of the vibrated assembly relative to the line of action of the driving forces.

The vibration-fluidization process can be carried out with an exceptionally low rate of attrition, thus minimizing decrepitation of the granular material processed, a particularly important advantage in handling coal, most grades of which are quite frangible.

Opposite ends of a dry vibration-fluidized separator are moved with complex vibrations, including linear, whirl, linear plus whirl, oscillation, linear plus oscillation, pitch and roll. Near zero to large amplitudes up to about ±0.050 inches and low frequencies of about 30 Hz are used. Mixed particulate materials are fed into a first end and circulate across and along the separator in a shallow depth. More dense materials move linearly along, a floor and are removed through an opening in a second end of the floor. The more dense materials flow over a weir at the second end of the separator.

A vibration-fluidizing bed method of separating solid materials of different densities vibrates a separator with complex vibrations and feeds mixed solid materials having different densities to the separator.

A fluidized flow of the materials is established in the separator with the complex vibrations. Dense materials move upward in the separator as a result of the complex vibrations. Less dense materials move along a bottom of the separator.

The more dense materials flow out of the conveyor from an upper portion of the separator and the less dense materials are discharged from a lower portion of the separator.

Preferably the vibrating comprises vibrating the separator with linear whirl, oscillation, linear plus whirl, linear plus oscillation, pitching and rocking motions.

The vibrating comprises vibrating the separator with motions varied from near zero to large amplitudes of ±0.050 inches or more.

Preferably the separator is a shallow separator.

The less dense materials are discharged through a hole in the bottom of the separator remote from the feeding. The more dense materials are flowed over a weir at one end of the separator.

The mixed solid particulate materials are fed into a top of the separator at one longitudinal end thereof.

The establishing of a fluidized flow includes establishing a circulation of the particulate material across and along the separator.

Vibrating the separator at low frequencies of about 30 Hz or less.

DETAILED DESCRIPTION OF THE PREFERRED EMBODIMENTS

Figure 3:
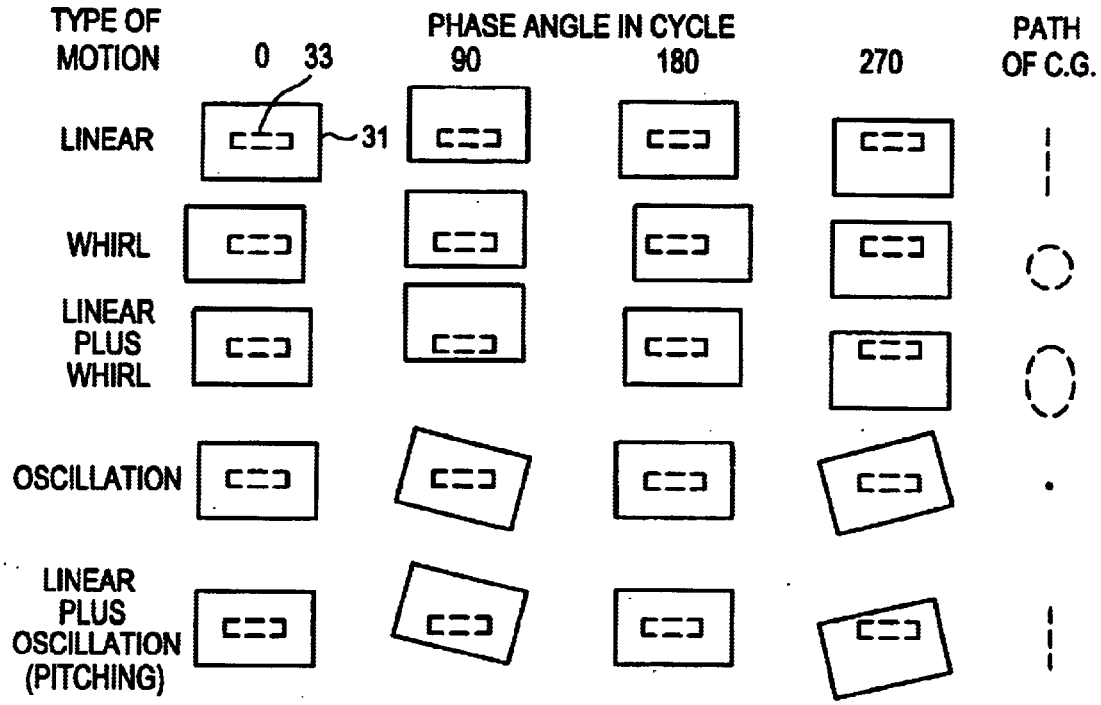
FIG. 3 is an illustration of the basic types of vibratory a motion.

The present invention is an apparatus and method for a dry separation process using a complex-mode vibration-fluidization, i.e., a carefully chosen combination of linear, whirl, oscillation, pitching, and rocking motions, as shown in FIG. 3, that is generated by machines especially designed to produce these unusual motions.

Experiments have been carried out with steel shot in sand and with magnetite in sand using a small 1×6 inch bed designed to operate in a wide variety of complex vibratory modes. These tests showed that while there is no measurable separation with linear motion, separation factors of at least 1.4 are obtainable by certain forced vibratory motions of complex-mode vibration-fluidized beds. The results of a typical set of tests are shown in Table 2.

Complex vibrating systems are difficult to analyze because they present so many subtle problems. There are so many elements in the machine structure affecting its stiffness and, hence, the natural frequency of resonant vibration for the various modes of motion that may be induced by the dynamics of the mechanism producing the vibration excitation for fluidizing the bed that a conventional cut-and-dry approach is highly unlikely to succeed. There are vastly more modes of motion that are unfavorable to any given process than there are modes that are favorable to that process, so the odds are strongly against random choices in a search for a good solution. Over twenty independent variables affect the particle motion and flow pattern in a vibration-fluidized bed, e.g.:

vibration frequency and amplitude;

vibration mode (linear, whirl, oscillation, rocking, etc.);

particle size and size distribution;

particle shape (from spherical to angular shards);

particle physical properties (density, hardness, elastic modulus, etc.);

bed depth, width, and length;

bed floor detail geometry and inclination;

sweep gas flow rate (from zero to incipient fluidization); and inflow rates of solids streams, and shape and location of feed spouts.

Analytical work serves at least to focus attention on the key factors, and tremendously narrows the range of promising steps to take in experiments. Further, the experiments must be carried out with special instrumentation, and vibration pickups such as accelerometers must be placed in the right spots and at the right angles to yield data on the vibratory motion that may be closely related to an incisive analysis.

Flow in a vibration-fluidized bed is fundamentally quite different from that in a liquid. At first glance, the flow in a vibrating bed appears to be similar to laminar flow in a liquid, but it is not, although there is no small-scale turbulence. Not only is the velocity distribution not parabolic, but there is no boundary layer; the flow usually seems to be very nearly pure slug flow. If a cylinder is thrust vertically downward into the surface of a flowing stream in a vibration-fluidized bed, the stream will divide and flow around the cylinder, leaving a triangular cavity rather than a turbulent wake downstream. That cavity has a length three or four times the diameter of the inserted cylinder, clearly showing that there is no small-scale turbulence, and that classical potential flow theory provides little insight into the flow patterns to be expected in a vibration-fluidized bed. Particle motion and flow patterns in a vibration-fluidized bed differ in vital respects from fluid motion in laminar or turbulent flow, and from particle motion and flow patterns in bubbling gas-fluidized beds. Particle momentum and kinetic energy, rather than static and hydrodynamic pressure forces, are the principal factors governing the motion of particles.

Figure 1:
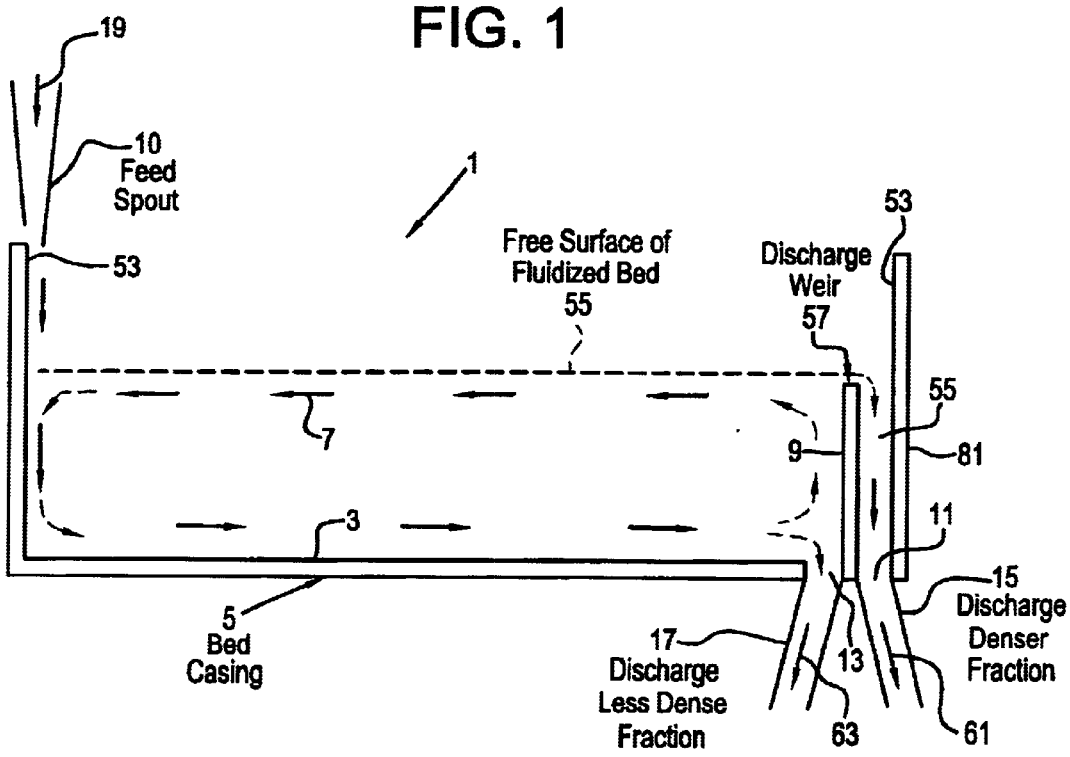
FIG. 1 is a side view of a complex-mode vibration-fluidized bed for density separation showing the bed flow pattern.

In appraising the possibility of density separation in a complex-mode vibration-fluidized bed 1 designed to produce circulation, as in FIG. 1, it seemed desirable to try to envision effects peculiar to complex-mode vibrating beds that might be beneficial for density separation. Differences in the momentum input to the particles from the floor 3 of the casing 5 seemed to offer some possibilities. It should be remembered that the floor 3 of the casing 5 comes in contact with the particles of the bed 1 only near the top center of the vibratory motion of the casing, at which point the floor of the casing impacts on the particles in the bottom layer of the bed of particles, striking the particles in the bottom layer as if they were ping pong balls. The impact imparts momentum that is transmitted upward through a vertical column of particles. There is very little relative motion between particles in this vertical column except at the top and bottom ends, much as in the similar case of the momentum transfer model shown in FIG. 2.

Figure 2:
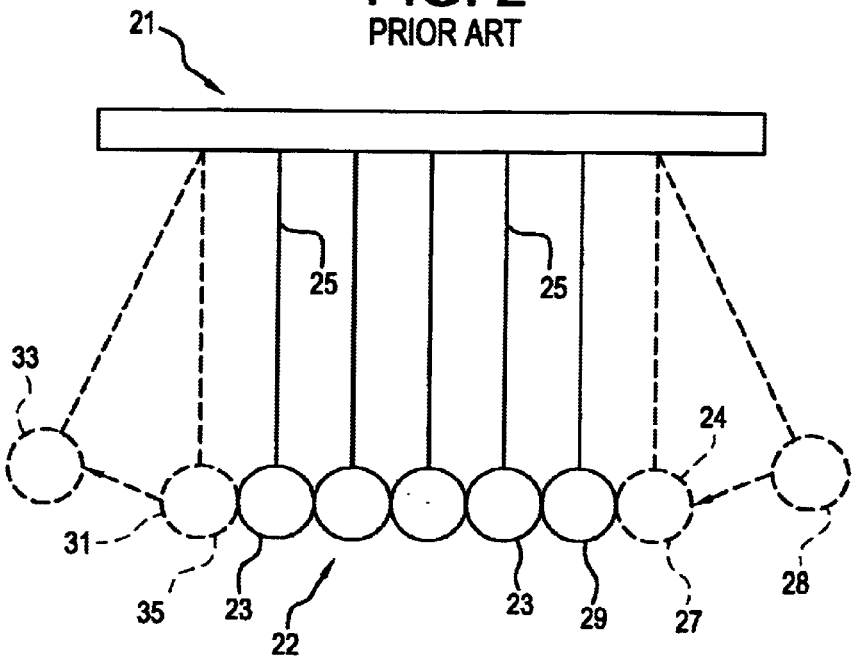
FIG. 2 PRIOR ART
FIG. 2 is an illustration of momentum transfer.

FIG. 2 illustrates a model 21 using steel balls 23 suspended on threads 25 to demonstrate the momentum transfer through a stack 22 of elastic spheres 23 when a sphere 24 at one end 27 is pulled back to position 28 and allowed to swing down to impact the end 29 of the column 22. The momentum is transferred through the stack 22 of spheres 23, resulting in the momentum imparting motion in sphere 31 to a position 33 at the other end 35 of the stack.

If the particles are all of about the same size and density, the adjacent columns move in unison. However, if some particles at the bottom of the bed 1 have a higher density, the momentum imparted to these high density particles by their impact with the casing floor 3 tends to give them a somewhat higher momentum, and thus a greater upward penetration of the bed, than would be the case for adjacent particles of the same size but with a lower density. The effect is similar to that of using an extremely dense material, such as uranium, rather than a moderately less dense material, such as lead for rifle bullets. The more dense particles tend to penetrate farther upward into the bed. Thus the lower density rather than the higher density particles tend to congregate at the bottom of the bed, the opposite of what one would expect from conventional hydrostatic forces.

By generating a favorable flow pattern 7 in the fluidized bed 1 and strategically placing outlet orifices 11 and 13 or weirs 9, a marked enrichment of the higher density material leaves one exit 15 and a reduced concentration leaves the other exit 17.

It appeared that if this hypothetical effect proved significant, it would be advantageous to make use of conditions somewhat different from those usually employed in vibration-fluidized beds. For example, a lower frequency of vibratory motion with a higher amplitude may be used to impart a greater momentum to the particle, and thus give a greater relative penetration of the bed by the high density particles. It also seemed likely that if this effect prevails there would be no advantage to the use of a deep bed because the bulk of the separation effect would be in the region close to the bottom of the bed. Inasmuch as the low and high density particles are uniformly mixed in the feed stream 19 that is introduced to the fluidized bed 1 through feed spout 10, it also seemed likely that it would be desirable to induce circulation in the bed with a pitching or rocking motion so that a large fraction of the dense particles are circulated across the floor 3 of the casing 5 for at least a portion of their axial transit through the bed 1. This leads to enrichment of the upper portion of the flow by dense particles driven upward from the floor through the bottom layer. The position and shape of the bed discharge ports 11 and 13 take advantage of this effect.

In planning the initial tests to separate higher density particles, previous observations of particle motions and flow patterns in complex-mode testing made it seem desirable to induce a pitching motion something like that used in panning for gold. One of the many ways in which this can be accomplished is to employ a two-shaft vibrating machine with the eccentric weights on one shaft larger than those on the other.

The pitching motion could be made even more pronounced by having the eccentric weights of the two shafts 180° out-of-phase. FIG. 3 shows several different vibratory modes obtainable with such a machine. FIG. 3 is a diagram showing the basic types of vibratory motion that may be combined to give complex-mode vibratory motions, such as the linear plus oscillation motion (pitching) shown in the bottom row of FIG. 3. The diagram shows the positions of the outer shell 31 relative to the at rest position of the inner core 33 at 90 degree intervals. The path of the center of gravity is shown in the final column. The vibratory motions shown in FIG. 3 are linear, whirl, linear plus whirl, oscillation, and linear plus oscillation (pitching).

Figure 4A:
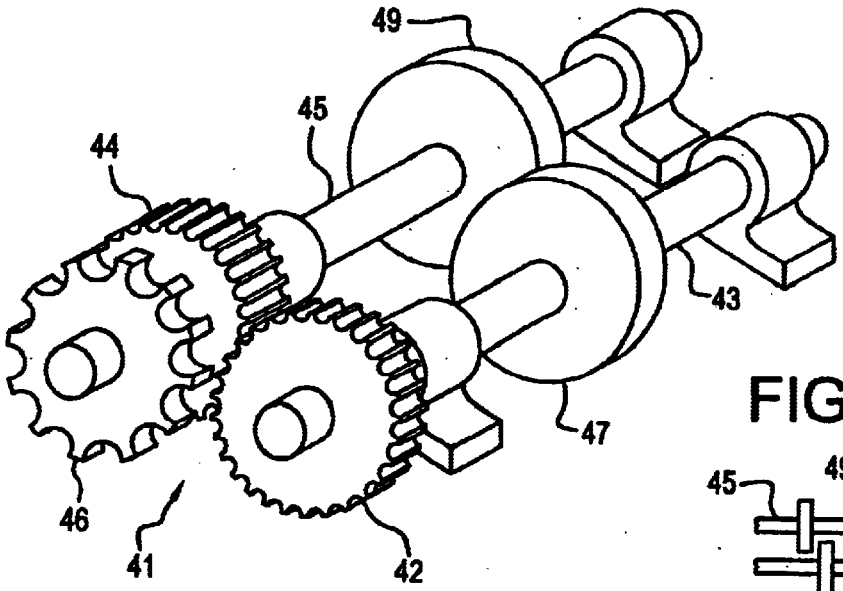
FIGS. 4A and 4B are a perspective view and a front view of a vibration exciter for producing linear vertical motion in a b complex-mode vibration-fluidized bed.
Figure 4B:
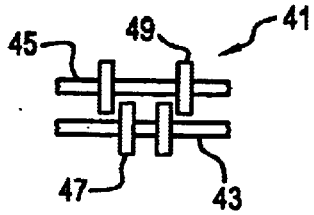

More complex vibratory motions may be obtained with the two-shaft 43 and 45 vibrating machine 41 of FIGS. 4A and 4B. FIGS. 4A and 4B show a vibration exciter 41 for producing linear vertical motion. Two of these machines 41 may be located at either end of a rigid frame and operated at different phase angles and with different amounts of eccentric weight to produce a wide variety of complex-mode vibration-fluidized bed behavior. The weights 47 and 49, shown as one per shaft 43 and 45, may be of the same size and weight or of different size and/or weight depending on the type of motion that is desired. As shown in FIG. 4B, the rotating weights 47 and 49 may be split to avoid side-to-side rocking of the vibration exciter 41. Timing gears 42 and 44 are preferably spur gears, as shown in FIG. 4A, because they are easier to align than beveled gears. Sprocket 46 imparts the motion generated by the vibration exciter 41 to the fluidized bed 1.

Figure 5:
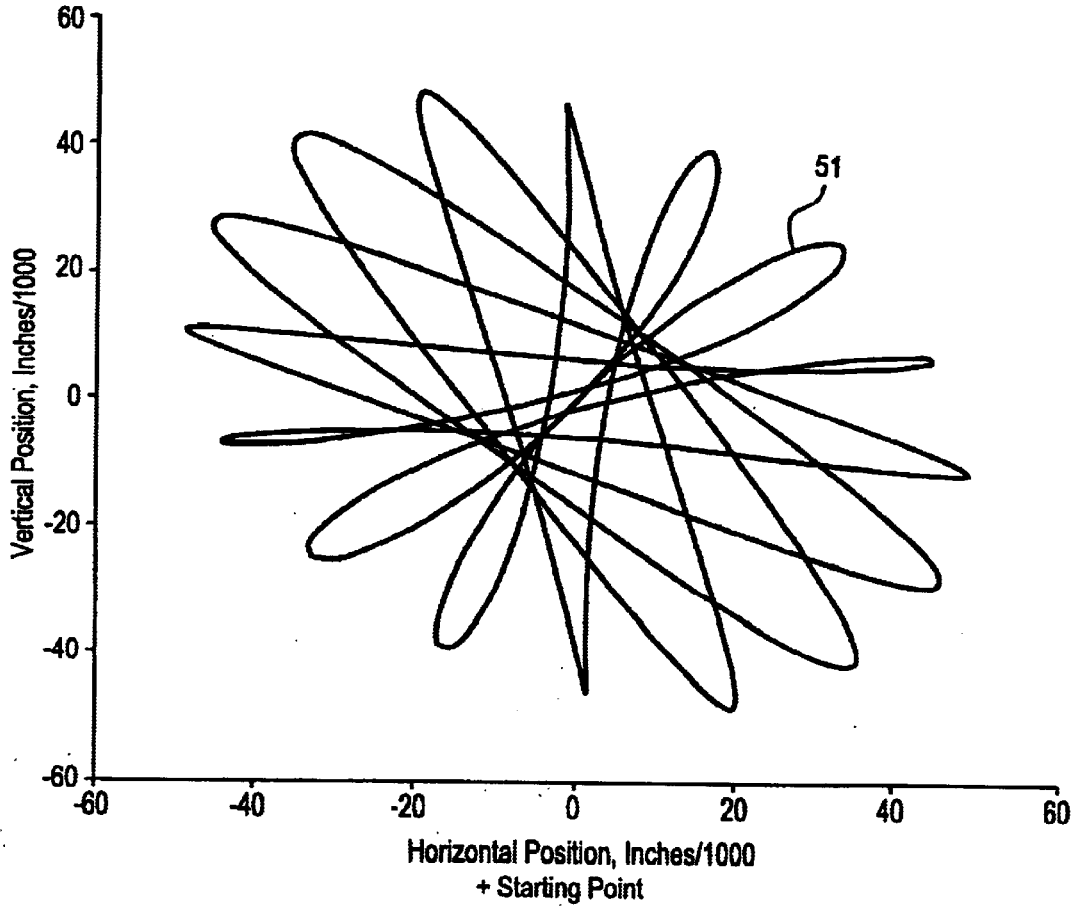
FIG. 5 is a graph of the motion of the midpoint between two shafts of a pair at one end of the complex-mode vibration-fluidized bed.

The path 51 of a point on the machine for one such complex mode is shown in FIG. 5. For more complex motions, a 2-shaft system may be placed at either end of the vibrating bed, and the motions generated may be very different for the two ends, except that their horizontal displacements must be the same and in-phase. One of the many special motions that is obtainable is achieved by operating one shaft 43 at half the frequency of the other shaft 45. The motion of the midpoint between the two shafts 43 and 45 of a pair at one end of the machine 1 is shown in FIG. 5.

Note that the vibratory motions shown in FIGS. 3 and 5 are for the bed casing 5. The vibration-fluidized particles of the bed itself generally move with the casing 5 in any given up and down cycle, but asymmetries in the impulses delivered to the particles in the bed near the top of the stroke of the casing induce low velocity circulation currents in the bed. Those motions of particles are hard to predict in detail, but the general effects may be envisioned from diagrams such as FIGS. 3 and 5, which define the motion of representative points in the casing.

Particle sizes, shapes, and physical properties other than density, particularly the modulus of elasticity, may also be factors in any separation effects. Table 1 shows the physical properties that may be significant for a number of minerals that appear to be of interest in separation processes, such as in ore beneficiation and coal cleaning operations. Unfortunately, the physical properties of rocks and minerals differ substantially as a consequence of differences in their geological history so that handbook data is often not available or varies considerably.

A series of preliminary scouting tests was carried out to investigate the possibility of employing a complex-mode vibration-fluidized bed in a density separation process. A 1×6 inch vibrating bed 1 (FIG. 1) on a small machine 41 (FIGS. 4A and 4B) designed and built to produce a wide variety of vibratory motions was at hand and was chosen as the test unit because it had proved invaluable, adaptable, and reliable in hundreds of hours of test work on other concepts. A drawing of a typical bed casing is shown in FIG. 1. The bed side walls 53 were made of Plexiglass so that the particle motion and bed flow patterns 7 may be viewed during operation. Note the weir 9 for discharging material from the top of the bed and the vertical discharge passage 57 at the lower right end of the bed casing for discharging material from the bottom of the bed. The height of the weir 9 at the discharge end is adjustable to permit operation with bed depths from 1 to 4 inches. The dotted line 55 shows the position of the bed free surface 55 for a typical set of conditions. In this case the bed depth was 2.5 inches. There is a square hole cut 13 in the floor 3 to provide a drain 17 at the discharge end 81. The drain port measured 0.25×0.25 inches giving a discharge port area of 0.062 square inches. This acted as an orifice that established the solids discharge flow rate from the bottom of the bed. On the other hand, the flow rate out of the top of the bed over the weir 9 increases with the inflow rate 19 with little increase in the bed depth at the discharge end 81. Thus the bed depth may be controlled independently of the inflow rate 19 by adjusting the height of the weir 9.

Two chutes 17 and 15 were fabricated of sheet aluminum and fitted respectively to the discharge port 13 through the floor 3 and over the top 57 of the weir 9. The base granular material chosen was −16+35 mesh silica sand with a mean particle size of about 700 $\mu$m and a grain density of about 2.7 g/cm$^3$, while the dense material was −16+30 mesh (mean particle size of 800 $\mu$m) magnetite with a grain density of 5.1 g/cm$^3$. While waiting for delivery of the magnetite a few tests were run using −16+30 mesh steel shot, which had a density 7.6 g/cm$^3$. Using a magnetic material for the dense particles made it possible to remove the dense material from the discharge streams 61 and 63 with a magnet. This gave an expeditious way to measure the weights of the low and high density fractions in each discharge stream and thus obtain a good measure of the degree of separation of the light and heavy fractions. After weighing, the magnetic material and sand were remixed and recycled for another test so that less than a kilogram of mix was required, which was a major advantage in this test series in which over 70 separate test runs were made. Another advantage to the combination of these two materials is that the black magnetite or steel shot contrasts strongly with the white sand to provide direct visual observation of both the flow patterns and the apparent concentration of the dense fraction for each vibratory mode tested, and thus provided valuable guidance in the choice of conditions for subsequent tests.

The most significant result of the tests is that the heavy fraction was discharged from the top 57 of the bed 1 rather than from the bottom drain 13, thus supporting the initial hypothesis that separation is induced by the greater momentum input to dense particles than to the lighter ones on impact with the bed floor 3, and a greater tendency for these particles to penetrate upward in the bed. This is consistent with, not only the separation mode observed, but also with the facts that spherical steel shot gave better separation characteristics than crushed magnetite, and that reducing the bed depth from 2.8 to 1.8 in improved both the apparent concentration of black particles in the upper layers of the bed in visual observations and the measured separation factor.

The data from the more significant of the tests run are summarized in Table 2. The left column gives the log sheet number and the run number on that log sheet. The testing was tedious because it was necessary to get accurate measures (within 0.1 g) for the gross weight of the total amount discharged from each spout, the weight of the sand and of the magnetite in each case, and then the tare weight of the container was subtracted to get the net weight for each case. The data was cross-checked for consistency as the tests progressed to assure not only the accuracy of the measurements but also that the operations were free of aberrations from small spills. The data for the net amounts from nine log sheets are summarized in Table 2.

The initial cases were run with a nearly linear vibratory motion; as expected these tests did not yield a significant separation factor, i.e., in this case the ratio of the concentration of the dense material in the discharge stream 61 from the top 57 of the bed to that in the discharge 63 from the bottom 13. The linear vibratory motion gave a weight fraction of the dense material in both discharge streams 61 and 63 within 1 or 2% of that in the feed stream 19, which was in the range of the experimental error inherent in these tests. A linear vibration driving force was used in which the line of action of the driving force was 0.5 inches from the center of gravity of the assembly in order to superimpose a mild pitching motion. This resulted in a small separation factor for operation with roughly spherical steel shot, and some of this data is included as the first five runs in Table 2.

However, when magnetite particles of the same size were used rather than spherical steel shot of the same size, as anticipated from the analysis presented above, the separation factor was very poor, apparently because the irregular particles of crushed magnetite tend to rebound isotropically from the vibrating floor 3 of the bed 1 rather than rebounding vertically as would be the case for spheres. Thus with a vibration mode yielding only a small separation effect, when operating with the angular particles of crushed magnetite the separation effect gained from the higher momentum of the denser particles is apparently largely vitiated in random movements.

In view of the poor separation factors found for operation with the mild pitching motions obtainable by offsetting the center of gravity with the linear driving motion, it was decided to change to a vibration mode that would give a stronger pitching motion. This was done by changing the shafting and eccentric weight system to shift from a simple linear driving force to a combination of linear and whirl motions, as shown in the bottom row of FIG. 3. A fairly strong pitching motion was generated by using a pitching moment arm of 2.05 inches between the line of action of the vertical component of the whirl and the center of gravity of the vibrated mass. This basic system was used for the balance of the tests, and the mass of the eccentric weight on the motor and the length of the moment arm were varied to change the amplitude of the shaking force and the degree of pitching in order to investigate these effects.

As suggested by the above discussion, many parameters (at least twenty), such as the vibration amplitude and frequency, may influence the behavior of a vibrated bed. For these preliminary scouting tests, the effects of changing ten of the twenty parameters were examined briefly. Measures of these changes are shown in the right-hand set of columns of Table 2. These columns show respectively the type of dense material employed, the, particle size, the bed depth, the vibration mode, the area of the bottom drain port, the moment arm inducing pitching, the mass of the eccentric weight on the drive to give an indication of both the amplitude of the vertical acceleration and the degree of pitching, the total solids flow rate through the bed, and the fraction of the feed to the bed in the form of dense material. To minimize clutter in Table 2, where a condition was kept constant the value for that condition was entered only when the condition was changed, and the next entry in the column is at the point where a subsequent change was introduced. Thus the blank spaces in these columns of Table 2 are the equivalent of ditto marks.

When running these preliminary scouting tests it was impracticable to control closely all but one of the many independent variables affecting the separation factor, the prime parameter of concern. As a consequence, there is considerable scatter in the points when plotting the separation factor against any one of the variables, enough so that it appeared that the effects of most of the parameters varied were relatively small. One reason for the small effects was that in these tests the ranges covered usually gave variations less than a factor of two in a given parameter.

To help analyze for the effects of the conditions varied in the tests, a different symbol was used for each set of conditions in which parameters other than the flow rate were kept constant, and these symbols are shown in the extreme right column of Table 2. Examination of the nine adjacent columns show which parameters were kept constant for the tests covered by each symbol.

Figure 6:
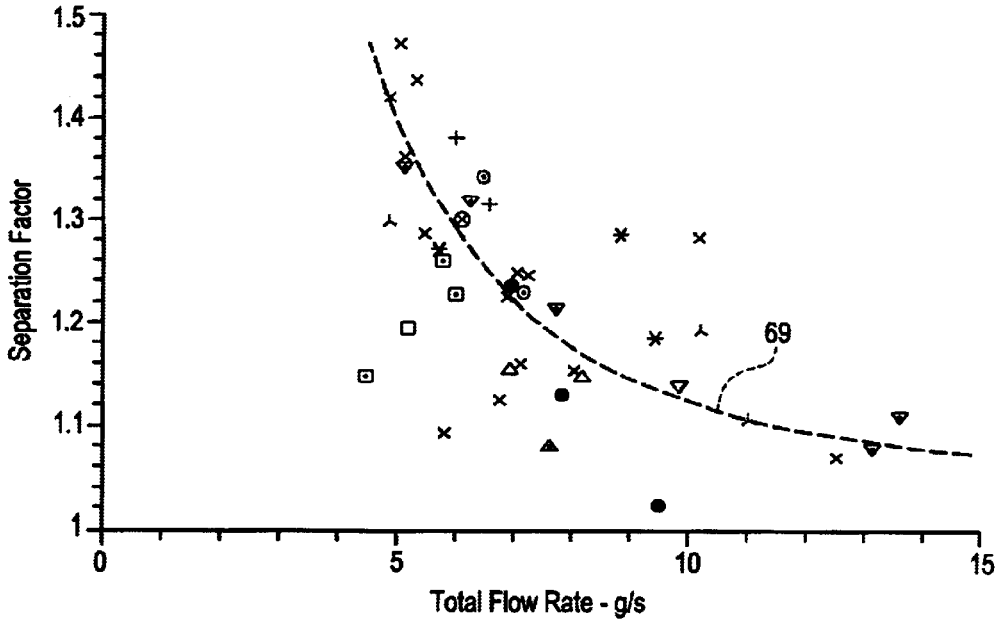
FIG. 6 is a graph of the separation factor as a function of the total flow rate for silica sand and magnetite flowing through a 1×6 inch vibrated bed operated at 30 Hz.

The first significant graph obtained is that shown in FIG. 6, in which the separation factor was plotted against the total solids flow rate through the bed for silica sand and magnetite flowing through a 1×6 inch vibrated bed operated at 30 Hz. The points were plotted from Table 2 using the symbols in the right-hand column of the table. The maximum flow was about three times that of the minimum. The scatterband is wide because points were plotted for every run. A mean curve 69 was drawn through these points to indicate the large effect of the solids flow rate on the separation factor. Unfortunately, the inlet feed rate 19 varied somewhat during a run, which affected the bed level distribution along the length of the bed, which in turn affected the ratio of the two discharge flows 61 and 63 (FIG. 1).

Figure 7:
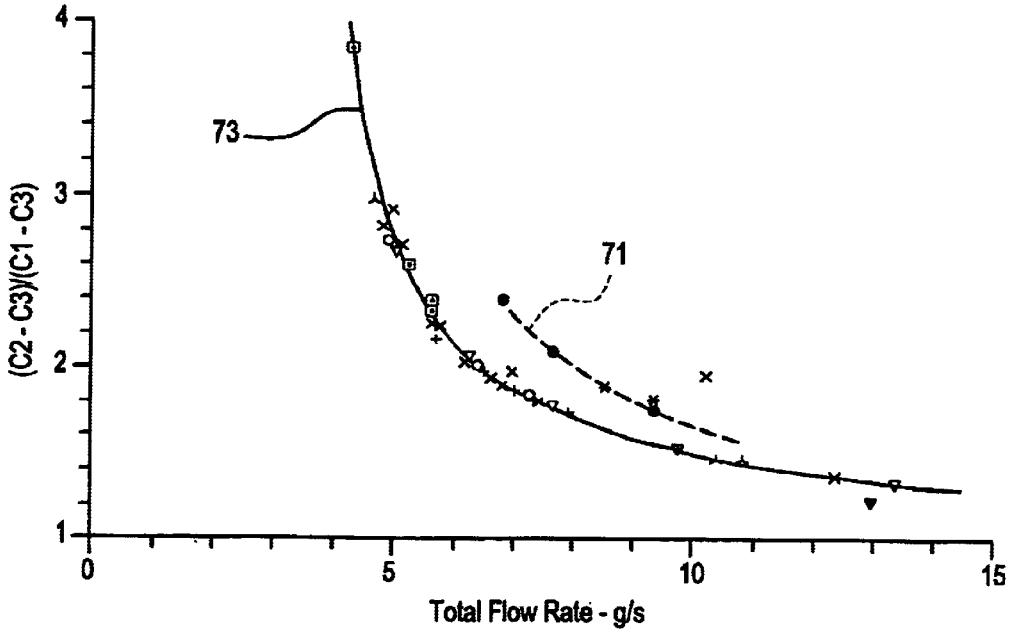
FIG. 7 is a replot of the graph of FIG. 6 using the difference between the dense fractions in the enriched and depleted discharge streams divided by the difference between the dense fractions in the feed and depleted discharge streams as a parameter.

The data of FIG. 6 was examined using another parameter that includes all three streams of solids, not just the inflow and the enriched outflow, i.e., a parameter that includes all of the factors involved in a complete material balance. This n parameter f is defined as:

$$f=(C_2-C_3)/(C_1-C_3)$$

where C is the concentration of the dense material in the total flow in any stream, and the subscripts 1, 2, and 3 signify the inlet, upper outlet, and lower outlet stream, respectively. The parameter f is the difference between the dense fractions in the enriched and depleted discharge streams divided by the difference between the dense fractions in the feed and depleted discharge streams. This parameter was calculated for each of the runs of Table 2 and plotted against the total flow to give FIG. 7. FIG. 7 shows that the only factor varied in the tests other than the total flow to have a discernable effect was the size of the orifice for the bottom drain. This resulted in two clearly defined curves 71 and 73, as shown in FIG. 7. Reducing the drain orifice size by 20% moved the curve 71 to the left 73 by 20% of the total flow. The lower curve 73 is for the smaller orifice for the depleted stream while the upper curve is for the larger orifice. The shape of this curve 73 is nicely consistent with that drawn initially through the scatterband of FIG. 6, and shows conclusively that the solids flow rate is an important factor, and that reducing the total solids flow rate increases the separation factor.

Several important points emerge from examination of the way some of the symbols fall relative to the mean curve of FIG. 7. For example, the last three points in Table 2 were obtained with a mean particle size that was half that of the others, yet these points also scatter closely around the mean curve. It is also interesting that the first set of data, that from Log No. 1 for steel shot, happened to be run at flow rates about double those for the runs with magnetite so that the points fall far to the right of the edge of FIG. 7, but these points gave separation factors close to the those obtained by extrapolating the curve for magnetite. This implies that the shape of the particles does not have much effect.

A major advantage of complex-mode vibration-fluidization is that the particle velocities are so low that the power requirements, the rate of particle attrition, and the rate of fine particle elutriation are exceptionally low. Tests of particle beds designed for similar processes to be carried out by vibration-fluidized beds, bubbling gas-fluidized beds, and entrained gas-fluidized beds have demonstrated that the complex-mode vibration-fluidized beds require one-tenth the power input, give less than 1% the rate of attrition, and 0.01% the rate of elutriation of bubbling gas-fluidized beds, and the differences are even greater for entrained beds.

While the invention has been described with reference to specific embodiments, modifications and variations of the invention may be constructed without departing from the scope of the invention, which is defined in the following claims.

TABLE 1

PHYSICAL PROPERTIES OF MINERALS FOR USE IN VIBRATING BEDS

| MATERIAL | PHYSICAL GRAIN DENSITY g/cm$^3$ | MODULUS OF ELASTICITY psi × $10^{-6}$ | VELOCITY OF SOUND m/s | HARDNESS Moh | SPECIFIC HEAT g-cal/g-K | THERMAL CONDUCTIVITY W/cm-K |
|---|---|---|---|---|---|---|
| $Al_2O_3$ | 3.5–4 | 40.2 | | 9 | 0.19 | |
| Barite | 4.5 | | | 3–3.5 | | |
| Brick | 1.4–2.2 | 3 | 4300 | | | |
| Calcite | 2.8 | | | 3 | | |
| Coal | 1.2–1.5 | | | | | |
| Coke | 1–1.7 | | | | | |
| Dolomite | 2.84 | 3–12 | | 3.5–4 | | |
| Fused Quartz | 2.65 | 10.4 | 5500 | 7 | 0.15 | |
| Glass | 2.4–2.8 | 12 | 5650 | 5–6 | 0.20 | |
| Gypsum | 2.32 | | | 3.5 | | |
| Hematite | 5.24 | | | 5–6 | | |
| Iron Pyrite | 5.0 | | | 6–6.5 | | |
| Limestone | 2.1–2.7 | 1.2–14 | | | | |
| Magnetite | 5.18 | | | 5.5–6.5 | | |
| Malachite | 3.7–4.1 | | | 4 | | |
| Marble | 2.6–2.8 | 8 | 3800 | | | |
| Sandstone | 2.14–2.3 | 1–8 | | | | |
| Slate | 2.6–3.2 | | | | | |

TABLE 2

Summary of Test Data on Density Separation 1 × 6 in. Vibrating Bed, 30 Hz

| L g No. | Top Total g | Top Dense g | Lower Total g | Lower Dense g | Top Conc. % | Separ Fact'r | Dense Mat'l | Bed Depth in. | Vibr. Mode | Drain Area in.$^3$ | Mom't Arm in. | Motor Ec. Wt g | Accelerometer g | Flow Rate g/s | Dense Fract % | Graph Symbol |
|---|---|---|---|---|---|---|---|---|---|---|---|---|---|---|---|---|
| 1-1 | 346.5 | 46.2 | 154.1 | 18.5 | .1333 | 1.032 | Steel | 2.8 | Linear | .06 | 0 | 57.7 | | 12.99 | | |
| 1-2 | 396.2 | 226.3 | 68.1 | 15.8 | .5712 | 1.095 | Shot | | | | | | | 27.27 | | |
| 1-3 | 327.6 | 171.8 | 76.3 | 22.3 | .5244 | 1.091 | | | | | | | | 21.17 | | |
| 1-4 | 261.2 | 135.5 | 76.1 | 15.5 | .5188 | 1.159 | | | | | | | | 17.73 | | |
| 1-5 | 283.8 | 143.6 | 79.1 | 17.2 | .5060 | 1.142 | | | | | | | | 18.35 | | |
| 2-1 | 118.5 | 34.7 | 163.2 | 32.6 | .2928 | 1.226 | Magnt | | Whirl | | 2.05 | | | 6.904 | | — |
| 2-2 | 134.5 | 36.7 | 143.7 | 30.5 | .2729 | 1.130 | 800 μm | | | | | | | 7.744 | | • |
| 2-3 | 119.5 | 29.8 | 88.2 | 21.1 | .2494 | 1.018 | | | | | | | | 9.420 | | — |
| 2-4 | 23.7 | 7 | 21.3 | 3.3 | .2954 | 1.290 | | 1.8 | | | | | | 8.451 | | * |
| 2-5 | 51.3 | 10.7 | 38.6 | 5.1 | .2086 | 1.187 | | | | | | | | 9.316 | 16 | |
| 2-6 | 30.3 | 5.9 | 72.2 | 9.9 | .1947 | 1.263 | | | | | | | 3.5/2.8 | 5.679 | | |
| 3-1 | 90.8 | 21.4 | 105.2 | 11.9 | .2357 | 1.387 | | | | .045 | | | | 5.962 | | — |
| 3-2 | 207.3 | 48.4 | 192.1 | 21.8 | .2335 | 1.328 | | | | | | | | 6.653 | | + |
| 3-3 | 98.6 | 20.8 | 80.7 | 11.9 | .2110 | 1.157 | | | | | | 74 | 4.5/2.4 | 7.110 | | — |
| 3-4 | 54.1 | 9.9 | 42 | 6.3 | .1830 | 1.086 | | | | | | | | 7.322 | | Δ |
| 3-5 | 116.8 | 24.3 | 79 | 11 | .2080 | 1.154 | | | | | | | | 7.931 | | — |
| 3-6 | 27.4 | 5.1 | 76.9 | 11.8 | .1861 | 1.149 | | | | | | 66.2 | 4.2/2.4 | 4.340 | | |
| 4-1 | 98.7 | 20.3 | 127.4 | 16.4 | .2057 | 1.267 | | | | | | | | 5.679 | | |
| 4-2 | 133.5 | 26.3 | 208.6 | 30 | .1970 | 1.197 | | | | | | | | 5.248 | | □ |
| 4-3 | 152.3 | 30.6 | 196.9 | 26.1 | .2009 | 1.237 | | | | | | | | 5.675 | | |
| 4-4 | 177.7 | 39 | 144.1 | 17.9 | .2195 | 1.241 | | | | | 2.69 | | 3.8/2.4 | 7.146 | | — |
| 4-5 | 103.5 | 24.1 | 183.3 | 21.1 | .2329 | 1.477 | | | | | | | | 5.007 | | ⊙ |
| 4-6 | 156.8 | 36.4 | 154.6 | 17.4 | .2321 | 1.344 | | | | | | | | 6.446 | | — |
| 5-1 | 137.3 | 25.5 | 174.8 | 27.5 | .1857 | 1.094 | | | | | | 74 | 3.6/2.6 | 5.714 | | — |
| 6-1 | 150.8 | 30 | 148.8 | 22.7 | .1989 | 1.131 | | | | | | | | 6.443 | | |
| 6-2 | 169.5 | 35.9 | 133.7 | 19.5 | .2118 | 1.159 | | | | | | | | 7.257 | | |
| 6-3 | 123.4 | 26.7 | 154.4 | 20 | .2164 | 1.287 | | | | | | | | 5.66 | | |
| 6-4 | 100.2 | 24.6 | 179.7 | 23.7 | .2455 | 1.423 | | | | | | | | 4.9 | | |
| 6-5 | 135.1 | 30.2 | 118.5 | 14.9 | .2235 | 1.257 | | | | | | | | 7.04 | | |
| 6-6 | 124.2 | 27.1 | 106.9 | 13 | .2182 | 1.257 | | | | | | | | 7 | | x |
| 7-1 | 117.4 | 24.5 | 120.9 | 13.6 | .2087 | 1.305 | | | | | | | | 6.27 | | |
| 7-2 | 196.7 | 42.8 | 181.3 | 24.2 | .2176 | 1.228 | | | | | | | | 6.75 | | |
| 7-3 | 126 | 30.1 | 238.1 | 33.6 | .2389 | 1.365 | | | | | | | | 5.06 | | |
| 7-4 | 130.5 | 31.9 | 220.6 | 27.5 | .2444 | 1.445 | | | | | | | | 5.16 | | |
| 7-5 | 164.3 | 37.2 | 151.3 | 18 | .2264 | 1.295 | | | | | | | | 10.2 | | |
| 8-1 | 99.1 | 15.9 | 36.3 | 4.4 | .1604 | 1.070 | | | | | | | | 12.3 | | — |
| 8-2 | 109.2 | 23.2 | 72.5 | 8.3 | .2125 | 1.225 | | | | | 2.05 | | | 7.57 | | |
| 8-3 | 300.1 | 62.4 | 99.1 | 12 | .2079 | 1.116 | | | | | | | | 13.3 | | |

TABLE 2-continued

Summary of Test Data on Density Separation 1 × 6 in. Vibrating Bed, 30 Hz

| L g No. | Top Total g | Top Dense g | Lower Total g | Lower Dense g | Top Conc. % | Separ Fact'r | Dense Mat'l | Bed Depth in. | Vibr. Mode | Drain Area in.$^3$ | Mom't Arm in. | Motor Ec. Wt g | Accel-erome-ter g | Flow Rate g/s | Dense Fract % | Graph Symbol |
|---|---|---|---|---|---|---|---|---|---|---|---|---|---|---|---|---|
| 8-4 | 262.8 | 56.5 | 129.4 | 17.3 | .2150 | 1.143 | | | | | | | | 9.8 | | ▽ |
| 8-5 | 234.1 | 43.5 | 46.7 | 5.1 | .1858 | 1.074 | | | | | | | | 13 | | |
| 8-6 | 74.6 | 11.6 | 124.9 | 11.2 | .1555 | 1.361 | | | | | | | | 5.111 | 9 | |
| 9-1 | 81.3 | 12.2 | 87.7 | 6.9 | .1501 | 1.328 | | | | | | | | 6.166 | | — |
| 9-2 | 38.7 | 10.9 | 75.5 | 13.9 | .2817 | 1.297 | 400 μm | | | | | | | 4.840 | | |
| 9-3 | 214.5 | 47.9 | 89.2 | 13.7 | .2233 | 1.101 | | | | | | | | 10.90 | | λ |
| 9-4 | 183.7 | 40 | 82.9 | 8.4 | .2177 | 1.199 | | | | | | | | 10.29 | | — |

I claim:

1. A vibration-fluidizing bed method of separating solid materials of different densities, comprising:

providing a separator;

vibrating the separator with complex vibrations;

feeding mixed solid materials having different densities to the separator;

establishing a fluidized flow of the materials in the separator with the complex vibrations;

moving more dense materials upward in the separator with the complex vibrations;

moving less dense materials along a bottom of the separator with the complex vibrations;

flowing the more dense materials out of a conveyor from an upper portion of the separator; and discharging the less dense materials from a lower portion of the separator.

2. The method of claim 1, wherein the vibrating comprises vibrating the separator with linear and whirl motions.

3. The method of claim 1, wherein the vibrating comprises vibrating the separator with linear and oscillation motions.

4. The method of claim 1, wherein the vibrating comprises vibrating the separator with linear and pitching motions.

5. The method of claim 1, wherein the vibrating comprises vibrating the separator with combinations of plural motions selected from the group of motions consisting of linear, whirl, linear plus whirl, oscillation, linear plus oscillation, pitching and rocking motions.

6. The method of claim 1, wherein the vibrating comprises vibrating the separator with combinations of plural motions, including linear, whirl, linear plus whirl, oscillation, linear plus oscillation, pitching and rocking motions.

7. The method of claim 1, wherein the vibrating comprises vibrating the separator with motions varied from near zero to large amplitudes.

8. The method of claim 1, wherein the providing of the separator comprises providing a shallow separator with a depth-to-length ratio of about 2 to 6 or less.

9. The method of claim 1, wherein the providing of the separator comprises providing a shallow separator.

10. The method of claim 1, wherein the discharging comprises discharging the less dense materials through a hole in the bottom of the separator remote from the feeding.

11. The method of claim 1, wherein the flowing comprises flowing the more dense materials over a weir at one end of the separator.

12. The method of claim 1, wherein the feeding comprises feeding the mixed solid particulate materials into a top of the separator at one longitudinal end thereof;

wherein the establishing of a fluidized flow comprises establishing a circulation of the particulate material across and along the separator;

wherein the flowing comprises flowing the more dense particles over a weir at a second longitudinal end of the separator; and wherein the discharging the less dense particles comprises dropping the particles through an opening in a bottom of the separator.

13. The method of claim 1, wherein the vibrating further comprises vibrating the separator at low frequencies.

14. The method of claim 1, wherein the vibrating further comprises vibrating the separator at frequencies of about 30 Hz.

15. The method of claim 1, wherein the vibrating further comprises vibrating the separator with plural motions varied in amplitude from near zero to about ±0.050 inches or more.

16. The method of claim 1, wherein the vibrating comprises vibrating the separator with motions being produced by machines having motor driven shafts fitted with eccentric weights, linkages drawn by electromagnets or fluid cylinders.

17. The method of claim 1, wherein the vibrating further comprises vibrating the separator at opposite longitudinal ends with differing vibrations.

* * * * *